US007892055B2

(12) United States Patent
Fukuoka

(10) Patent No.: US 7,892,055 B2
(45) **Date of Patent: *Feb. 22, 2011**

(54) OUTBOARD MOTOR

(75) Inventor: Yoshihito Fukuoka, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 186 days.

This patent is subject to a terminal disclaimer.

(21) Appl. No.: 12/339,192

(22) Filed: Dec. 19, 2008

(65) Prior Publication Data

US 2009/0163093 A1 Jun. 25, 2009

(30) Foreign Application Priority Data

Dec. 20, 2007 (JP) ..... 2007-328292

(51) Int. Cl.
*B63H 20/28* (2006.01)
*F01P 3/20* (2006.01)
*F02B 61/04* (2006.01)

(52) U.S. Cl. ..... 440/88 M

(58) Field of Classification Search ..... 440/88 R, 440/88 C, 88 M, 88 P
See application file for complete search history.

(56) References Cited

U.S. PATENT DOCUMENTS 5,383,440 A * 1/1995 Koishikawa et al. ..... 123/572
5,931,711 A 8/1999 Nakamura
6,416,370 B1 * 7/2002 Bland et al. ..... 440/61 R

FOREIGN PATENT DOCUMENTS

JP 3509171 B2 3/2004

OTHER PUBLICATIONS

Fukuoka; "Outboard Motor"; U.S. Appl. No. 12/339,181, filed Dec. 19, 2008.

* cited by examiner

*Primary Examiner*—Daniel V Venne
(74) *Attorney, Agent, or Firm*—Keating & Bennett, LLP

(57) ABSTRACT

A motor including an intake-side conduit member disposed outside a casing that makes a connection between a cooling water intake section of a water pump and an intake hole, and a cooling water relay section provided outside the casing. The cooling water relay section communicates with a cooling water supply passage in the casing. A discharge-side conduit member that is disposed outside the casing connects the cooling water relay section to a cooling water discharge section of the water pump. Additionally, the other end of a transmission cooling conduit member that is branched from the cooling water relay section is connected to a water jacket of the transmission. The conduit members are preferably flexible hose members, for example. Accordingly, this unique construction improves a cooling water piping layout around a water pump, a discharge performance of the water pump, and an assembly workability of a motor.

7 Claims, 6 Drawing Sheets

OUTBOARD MOTOR

BACKGROUND OF THE INVENTION

1. Field of the Invention

The present invention relates to an outboard motor configured to supply outside water drawn in through a water pump to an engine and other heat-generating components for the purpose of using the water to cool the engine and the other heat-generating components of the outboard motor.

2. Description of the Related Art

In a conventional outboard motor, a water pump is placed near a lower portion of a casing and driven by a drive shaft for transmitting engine output to a propeller. An intake hole is provided in a casing below a waterline. When the water pump is activated, outside water is drawn in from the intake hole and sucked into the water pump. The water that has been sucked into the water pump travels through a cooling water conduit member, which is made of metal and arranged to extend upward in the casing, and is supplied to the engine (see JP-B-3745470 and JP-B-3509171, for example).

However, various components such as the drive shaft, a transmission, an oil pan, and an expansion chamber are housed in the casing. Thus, in order to avoid interference with the above components, a bore diameter of the cooling water conduit member cannot be set large enough. Consequently, discharging performance of the water pump is sacrificed.

In addition, since the cooling water conduit member runs near or inside the expansion chamber, there is a concern about deterioration of both the cooling water conduit member and a sealing member for the cooling water conduit member due to high exhaust heat and exhaust components.

SUMMARY OF THE INVENTION

In order to overcome the problems described above, preferred embodiments of the present invention provide an outboard motor with an improved cooling water piping layout around a water pump, improved discharging performance of the water pump, and improved assembly workability.

In order to solve the above problems, a preferred embodiment of the present invention is directed to an outboard motor in which an engine is mounted above a casing, output of the engine is transmitted to a propeller shaft through a drive shaft pivotally supported in the casing, and a water pump is included to draw in outside water from an intake hole provided below the casing and to then supply the outside water to the engine as cooling water. An intake-side conduit member with an upstream end connected to the intake hole and a downstream end connected to a cooling water intake section of the water pump is disposed outside the casing.

Because the intake-side conduit member is disposed outside the casing, the intake-side conduit member can be freely installed without influence of other components disposed in the casing. Thus, the layout of the intake-side conduit member can be improved. The discharging performance of the water pump can also be improved by enlarging the bore diameter of the intake-side conduit member. It is further possible to prevent deterioration of the intake-side conduit member caused by exhaust heat and exhaust components.

In addition to the configuration described above, another preferred embodiment of the present invention is directed to an outboard motor in which a discharge-side conduit member is disposed outside the casing. An upstream end of the discharge-side conduit member is connected to a cooling water discharge section of the water pump, and a downstream end thereof is connected to a cooling water supply passage that is defined in the casing and supplies cooling water to a side of the engine.

Accordingly, the discharge-side conduit member can be freely installed without influence of other components disposed in the casing. Thus, the layout of the discharge-side conduit member can be improved. The discharging performance of the water pump can also be improved by enlarging the bore diameter of the discharge-side conduit member. The discharge-side conduit member can further be prevented from deterioration caused by exhaust heat and exhaust components. Moreover, the layout of the cooling water supply passage led to the engine is improved.

In addition to the configurations described above, another preferred embodiment of the present invention is directed to an outboard motor provided with a cooling water relay section in the outside of the casing. The cooling water relay section is communicated with the cooling water supply passage and is connected with the downstream end of the discharge-side conduit member.

Accordingly, the layouts of the discharge-side conduit member and cooling water supply line can further be improved.

In addition to the configurations described above, another preferred embodiment of the present invention is directed to an outboard motor in which the cooling water relay section is connected with at least one branch conduit member that distributes cooling water supplied from the discharge-side conduit member to a passage that is different from the cooling water supply passage.

Thus, components other than the engine can be easily cooled down. In addition, the branch conduit member can be disposed outside the casing to improve the layout thereof.

In addition to the configurations described above, another preferred embodiment of the present invention is directed to an outboard motor in which bore diameters of the intake-side conduit member and the discharge-side conduit member are different from a bore diameter of the branch conduit member.

With the different setting of the bore diameter of each conduit member, it is possible to easily set a ratio of cooling water supply to the engine to cooling water supply to the cooled components other than the engine. In other words, a diversion device that permits easy alteration of a diversion ratio is unnecessary. Due to the lack of complicated configurations, further improvement in the layout can be attained.

In addition to the configurations described above, another preferred embodiment of the present invention is directed to an outboard motor in which the other end of the branch conduit member is connected to a water jacket for cooling a transmission.

Accordingly, the transmission, which is a second primary heat-generating component after the engine, can be effectively cooled down together with the engine by the simple piping layout.

In addition to the configurations described above, another preferred embodiment of the present invention includes a water pump that is arranged to be exposed outside the casing.

Thus, it is possible to facilitate a connection between the intake-side conduit member, which is connected to the cooling water intake section of the water pump, and the discharge-side conduit member connected to the cooling water discharge section. Accordingly, the assembly workability of the outboard motor can be improved.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will hereinafter be described with reference to FIG. 1 to FIG. 7.

Figure 1:
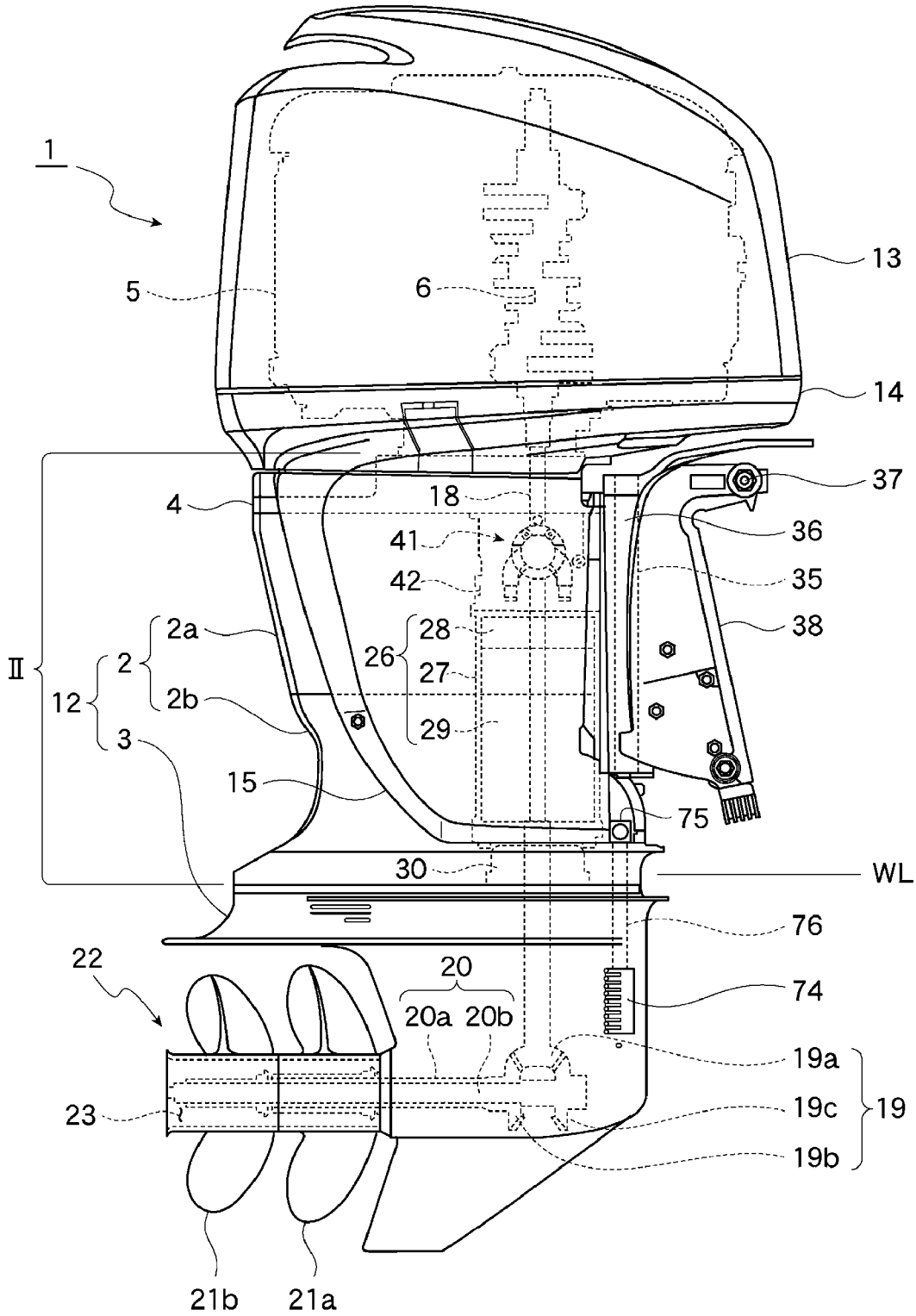
FIG. 1 is a right side view for showing an outboard motor according to a preferred embodiment of the present invention.
Figure 2:
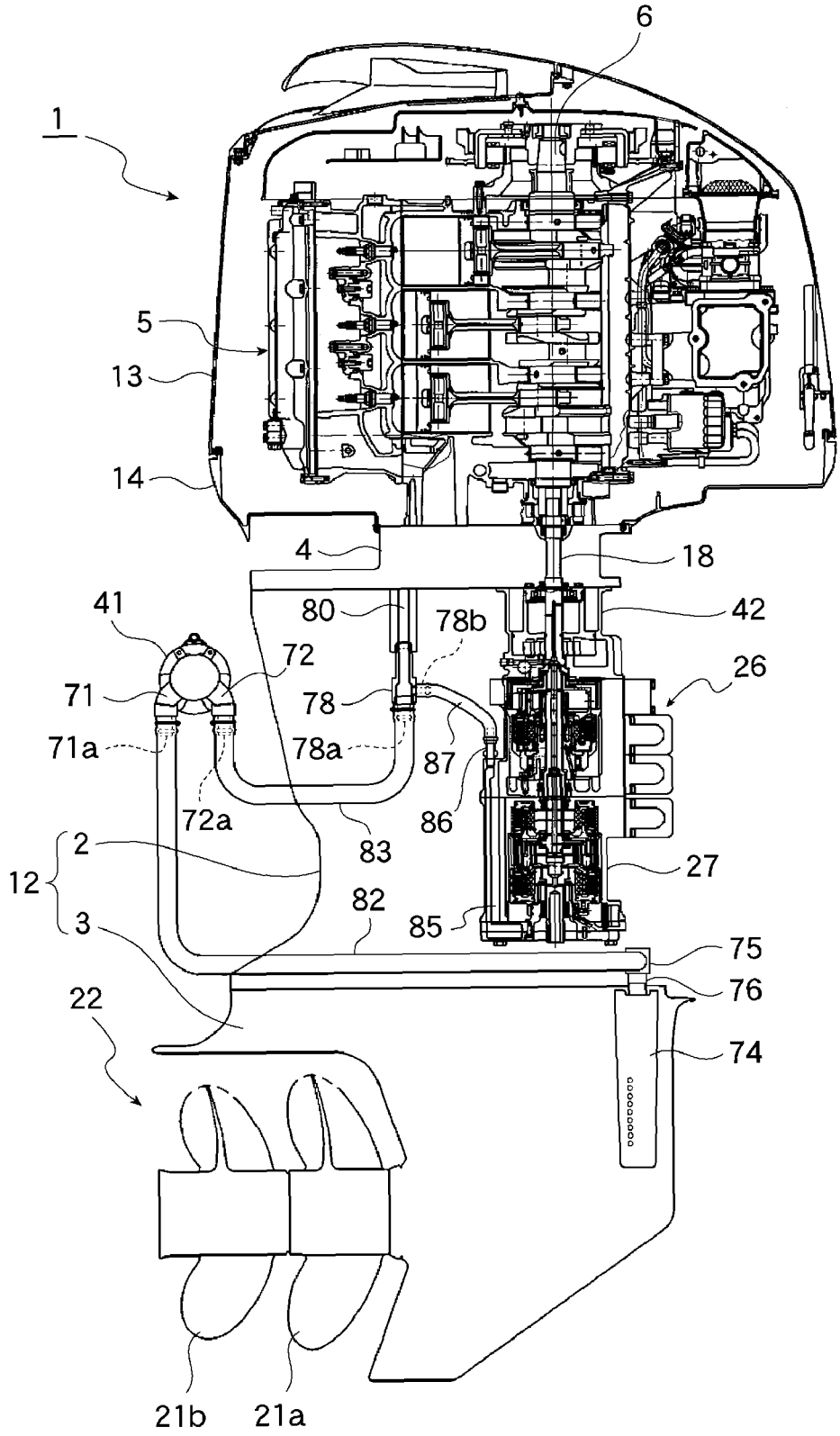
FIG. 2 is a vertical sectional view of a section II in FIG. 1 according to a preferred embodiment of the present invention.
Figure 3:
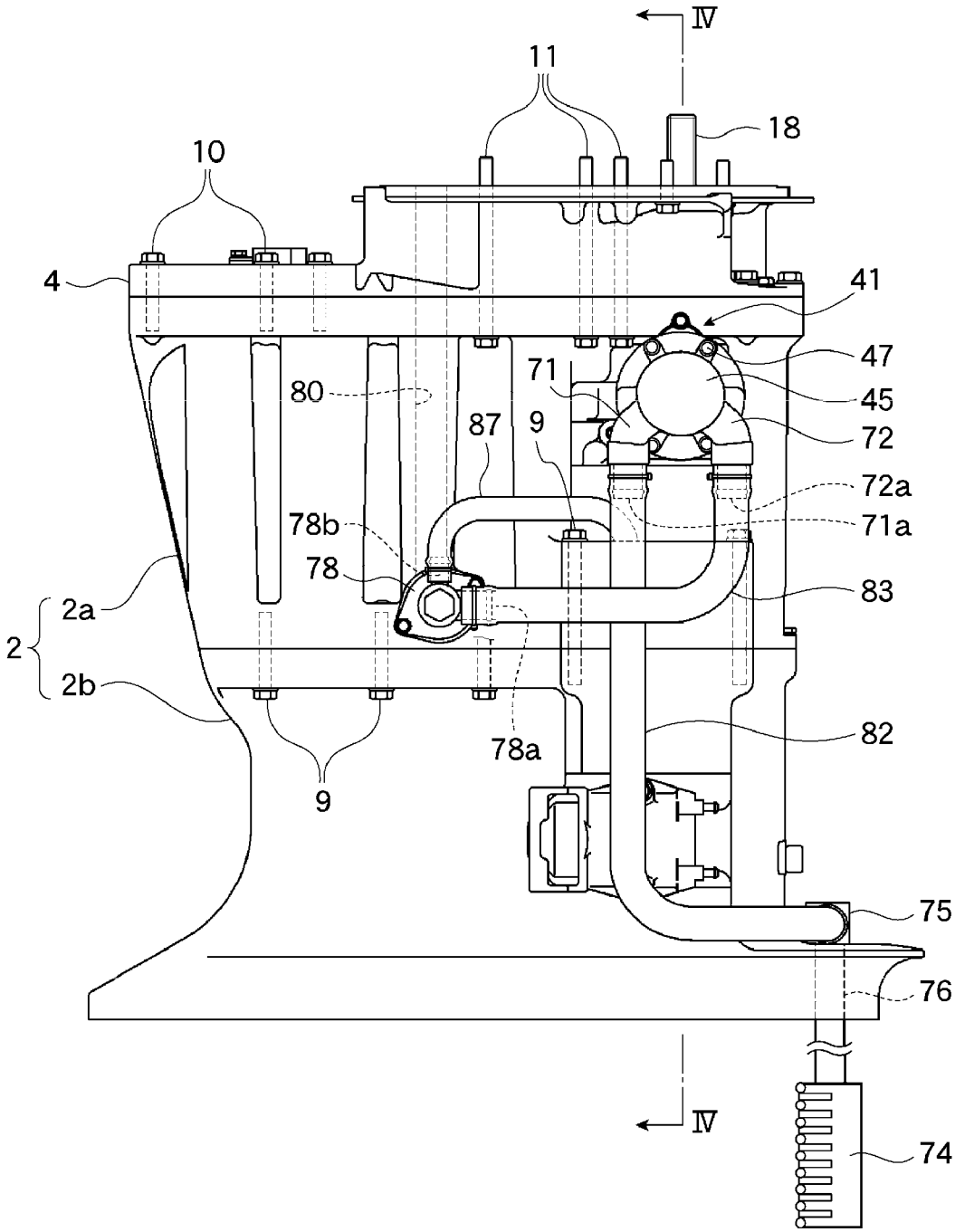
FIG. 3 is an enlarged view of a section III in FIG. 1 according to a preferred embodiment of the present invention.
Figure 4:
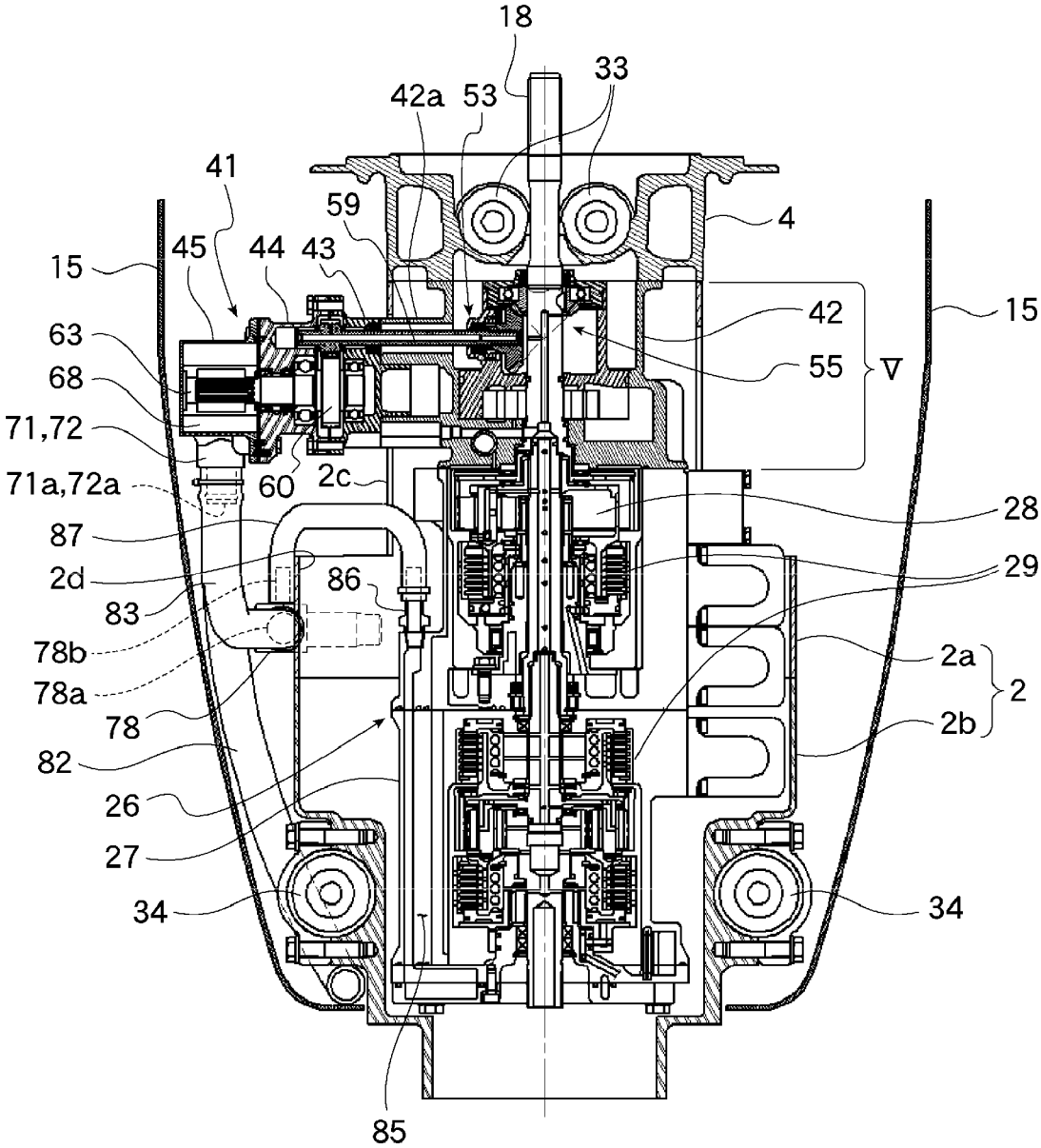
FIG. 4 is a vertical sectional view taken along the line IV-IV in FIG. 3 according to a preferred embodiment of the present invention.

FIG. 1 is a right side view showing a preferred embodiment of an outboard motor according to the present invention. FIG. 2 is a vertical sectional view of FIG. 1 in more detail. FIG. 3 is an enlarged view of a section III in FIG. 1. FIG. 4 is a vertical sectional view taken along the line IV-IV in FIG. 3.

In an outboard motor 1, a lower casing 3 is disposed under an upper casing 2, and an engine 5 is mounted on top of the upper casing 2 via a generally flat mounting plate 4. The engine 5 is preferably a water-cooled V6 engine and is set on the mounting plate 4 in such that a crankshaft 6 thereof is in a vertical position.

For example, the upper casing 2 adopts a horizontally split structure in which an upside casing 2*a* and a downside casing 2*b* are fastened to each other with a plurality of fixing bolts 9. The mounting plate 4 is fixed to an upper surface of the upside casing 2*a* with a plurality of fixing bolts 10 and through bolts 11. The lower casing 3 is fixed to a lower surface of the downside casing 2*b* with a fixing bolt, which is not shown. The upper casing 2 and the lower casing 3 then make up a casing 12. The through bolt 11 is inserted from below an upper flange of the upside casing 2*a* through the mounting plate 4 and then tightened to the engine 5 so as to fasten the three members 2*a*, 4, 5.

The engine 5 is covered with a detachable upper cover 13 and a detachable lower cover 14. A right side surface and a left side surface of the upper casing 2 are covered with a side cover 15, which is also detachable. Here, FIG. 3 shows a condition that the side cover 15 is removed.

A drive shaft 18 is vertically supported in the casing 12. The drive shaft 18 is axially divided into multiple stages, and a top end thereof is preferably spline-fitted to a bottom end of the crankshaft 6. A bottom end of the drive shaft 18 reaches the inside of the lower casing 3 and is coupled to a propeller shaft 20, which is horizontally supported in the lower casing 3, via a bevel gear mechanism 19. A transmission 26, which is later described, is mounted on a midsection of the drive shaft 18.

The propeller shaft 20 is a double-rotary shaft that coaxially combines an outer shaft 20*a* with an inner shaft 20*b*. A drive bevel gear 19*a* of the bevel gear mechanism 19 rotates as a unit with the drive shaft 18, a driven bevel gear 19*b* rotates as a unit with the outer shaft 20*a*, and a driven bevel gear 19*c* rotates as a unit with an inner shaft 20*b*. A first propeller 21*a* is fixed to the outer shaft 20*a*, and a second propeller 21*b* is fixed to the inner shaft 20*b*. These propellers make up a contra-rotating propeller mechanism 22. An exhaust passage 23 is formed in the axes of the first propeller 21*a* and the second propeller 21*b*.

The transmission 26 is provided in the casing 12 (the upper casing 2). The transmission 26 is mounted on the drive shaft 18 and houses an automatic gear change system 29 that includes a planetary gear train 28 and a forward/reverse switch in a transmission case 27 that defines an outer shell of the transmission 26. An intermediate reduction gear 30 is provided immediately below the transmission 26 (see FIG. 1).

When the engine 5 is activated, rotation of the crankshaft 6 is transmitted to rotate the drive shaft 18. The rotational speed of the drive shaft 18 is first shifted in the transmission 26, and a rotational direction of the drive shaft 18 is switched to a forward or reverse direction. Next, the rotation of the drive shaft 18 is decelerated by the intermediate reduction gear 30 and the bevel gear mechanism 19 and is transmitted to the propeller shaft 20. Then, the outer shaft 20*a* of the propeller shaft 20 and the propeller 21*a* rotate in an opposite direction from the inner shaft 20*b* and the second propeller 21*b* in order to produce a high propulsive force.

With reference to FIG. 4, a steering bracket (not shown) is coupled and secured to a front section of the outboard motor 1 through a pair of right and left upper mounts 33 embedded in the mounting plate 4 and a pair of right and left lower mounts 34 respectively provided on a right and a left sidewall of the downside casing 2*b* of the upper casing 2. The steering bracket is coupled to a swivel bracket 36 by a vertical steering shaft 35 shown in FIG. 1. The swivel bracket 36 is coupled to a clamp bracket 38 through a horizontal swivel shaft 37 and a lock mechanism, which is not shown. The clamp bracket 38 is preferably secured to a transom of a watercraft.

The outboard motor 1 can steer the watercraft by pivoting to the right and left about the steering shaft 35, and can also be tilted up above the water surface by pivoting vertically about the swivel shaft 37.

Figure 5:
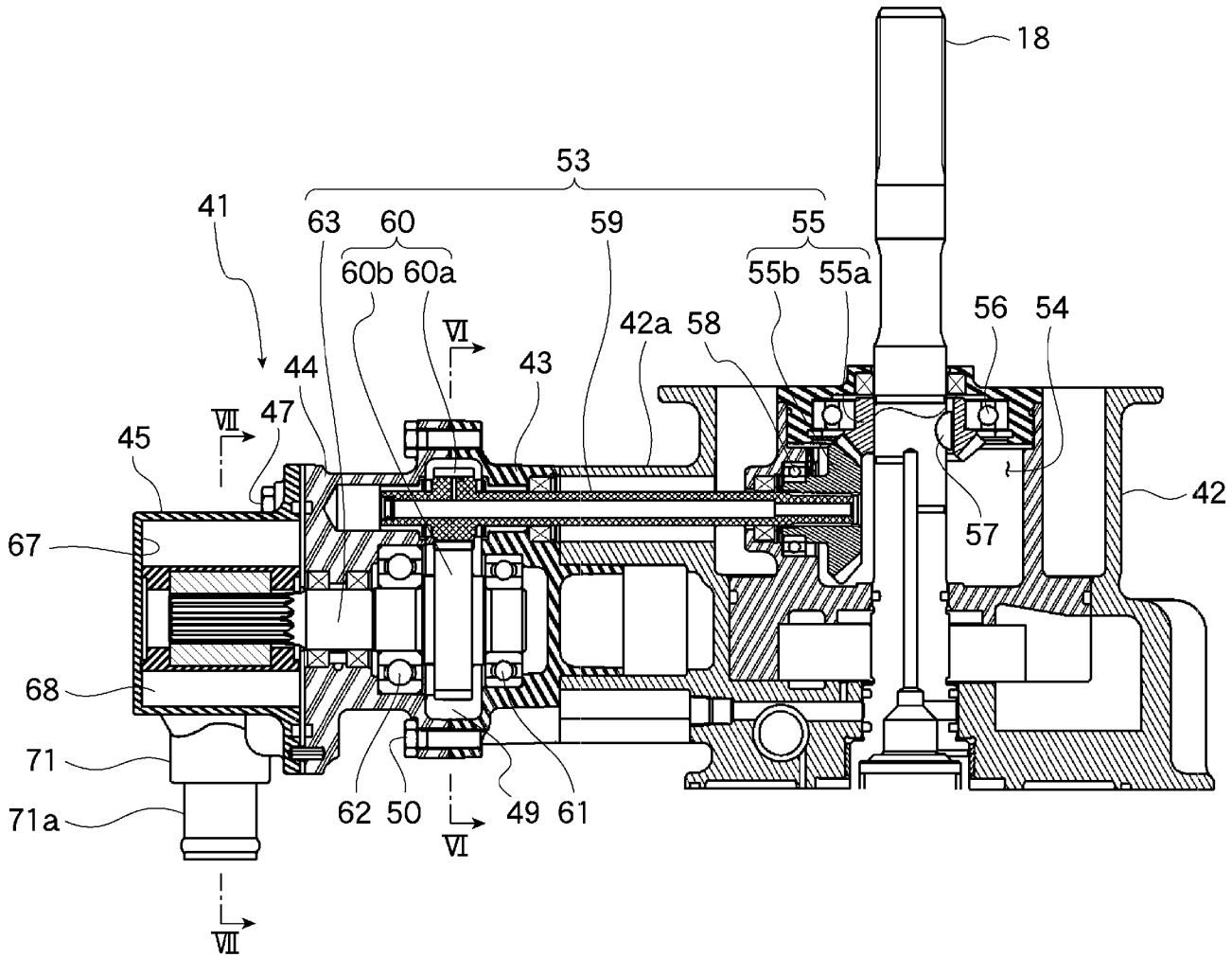
FIG. 5 is a vertical sectional view of an enlarged section V in FIG. 4 according to a preferred embodiment of the present invention.
Figure 6:
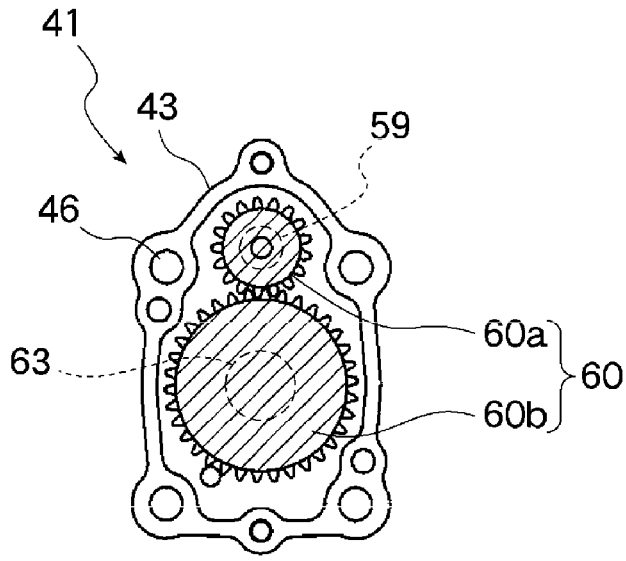
FIG. 6 is a vertical sectional view taken along the line VI-VI in FIG. 5 according to a preferred embodiment of the present invention.
Figure 7:
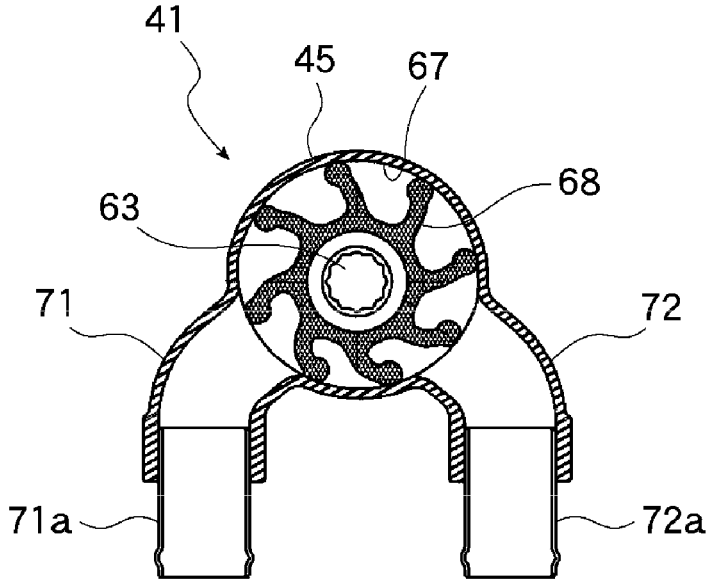
FIG. 7 is a vertical sectional view taken along the line VII-VII in FIG. 5 according to a preferred embodiment of the present invention.

As shown in FIGS. 5 to 7, a water pump 41 arranged to draw in cooling water for the engine 5 is disposed on an outer surface of the casing 12, or on a right side surface of the upper casing 2 in a traveling direction of the watercraft, for example. An installation position of the water pump 41 is located higher than the position of the transmission 26 and is also sufficiently higher than a waterline WL during operation of the outboard motor 1 (see FIG. 1). Here, the water pump 41 is displaced in FIG. 2 for a better understanding of the configuration.

A separate pump mounting case 42 is in close contact with and fixed to an upper surface of the transmission case 27 of the transmission 26 that is disposed in the upper casing 2. An upper surface of the pump mounting case 42 is in close contact with and fixed to a lower surface of the mounting plate 4.

An extension 42*a* that extends horizontally to the right is integrally formed with a right side surface of the pump mounting case 42. Meanwhile, on a right side surface of the upper casing 2*a* that defines the upper case 2, a pump opening 2*c* is provided in a portion in the proximity of a right side of the pump mounting case 42 (see FIG. 3). The extension 42*a* of the pump mounting case 42 projects outward to the right from the pump opening 2*c* The pump opening 2*c* is formed in a step-like pocket shape, which also opens downward.

An inner gear housing 43, an outer gear housing 44, and a pump housing 45 are water-tightly attached to the extension 42*a* such that one overlaps with another on its right in series. These three members 43, 44, 45 and the extension 42*a* define a major portion of the water pump 41. As shown in FIG. 6, a pump fixing bolt 47 (see FIGS. 3 and 5) penetrates through a bolt hole 46 that is preferably provided through each of four corners of the above three members 43, 44, 45. The pump fixing bolt 47 is then tightened to the extension 42*a* to fasten the three members 43, 44, 45 to the extension 42*a*.

As described above, each of the inner gear housing 43, the outer gear housing 44, and the pump housing 45, which define the main portion of the water pump 41, project outward from the pump opening 2*c* provided in the upper casing 2. Thus, the three members 43, 44, 45 can be easily removed from the outside of the upper casing 2 simply by unscrewing the pump fixing bolt 47 from the outside.

A reduction gear chamber 49 is provided in a watertight state between the inner gear housing 43 and the outer gear housing 44. The gear housings 43, 44 are fastened preferably with two assembly bolts 50 that are exclusive for this use and are different from the pump fixing bolt 47, which is described above, for example.

The water pump 41 is driven by the rotation of the drive shaft 18 that is decelerated and then transmitted to the water pump 41 by a pump drive mechanism 53 using a bevel gear mechanism and a reduction gear mechanism, described below.

The pump drive mechanism 53 is provided in the proximity of the transmission 26, for example, from the pump mounting case 42 (the extension 42*a* ) to the inside of the water pump 41. The pump drive mechanism 53 is also configured as follows so that it takes power in a direction perpendicular or generally perpendicular to an axial direction of the drive shaft 18, such as, for example, in a right direction, to transmit the power to the water pump 41.

A pump power takeoff chamber 54 is defined inside the pump mounting case 42 and houses a bevel gear mechanism 55. The bevel gear mechanism 55 includes a drive bevel gear 55*a* and a driven bevel gear 55*b*. The drive bevel gear 55*a* is rotatably supported in a pump mounting case 42 by a bearing 56 so as to rotate as a unit with the drive shaft 18 through a woodruff key 57. The driven bevel gear 55*b* is rotatably supported by a bearing 58 and meshes with the drive bevel gear 55*a*. A gear ratio of the bevel gear mechanism 55 is set at 1:1, for example.

A hollow pump drive shaft 59 that follows a width direction of the outboard motor 1 penetrates from the extension 42*a* to the insides of the inner and the outer gear housings 43, 44. The pump drive shaft 59, at its left end, is coupled to the driven bevel gear 55*b* for unitary rotation therewith through spline-fitting and the like. A hollow portion 59*a* is provided in the axis of the pump drive shaft 59.

A reduction gear mechanism 60 (for example, a spur gear mechanism) is housed in the reduction gear chamber 49. The reduction gear mechanism 60 preferably includes a reduction drive gear 60*a* and a reduction driven gear 60*b* that meshes with the reduction drive gear 60*a*. These gears 60*a*, 60*b* may be helical gears, for example, and a gear ratio is set at approximately 1:1.5 to approximately 1:2.

While the reduction drive gear 60*a* is integrally formed with the pump drive shaft 59 near the right end thereof, the reduction driven gear 60*b* is integrally provided with an impeller shaft 63. The impeller shaft 63 is pivotally supported by a bearing 61 disposed in the inner gear housing 43 and also by a bearing 62 disposed in the outer gear housing 44. The rotation of the pump drive shaft 59 is decelerated at approximately 1/1.5 to approximately 1/2 by the reduction gear mechanism 60 and then transmitted to the impeller shaft 63.

The pump drive mechanism 53 includes a plurality of power transmission mechanisms, preferably the bevel gear mechanism 55 and the reduction gear mechanism 60 as described above, and further includes the pump drive shaft 59 and the impeller shaft 63. However, the pump drive mechanism 53 is not limited to the above configuration and may adopt another drive system.

A right end of the impeller shaft 63 eccentrically passes the inside of an impeller chamber 67 defined in the pump housing 45, and is provided with an impeller 68 from a free end side for unitary rotation such as, for example, by spline-fitting. The impeller 68 is preferably made of an elastic material such as, for example, rubber and urethane, and is arranged in a water wheel shape with eight blades, for example. The impeller shaft 63 and the impeller 68 are eccentric with respect to an axis of the impeller chamber 67, and side surfaces and blade tips of the impeller 68 respectively contact the right and left side surfaces and an inner periphery of the impeller chamber 67. Accordingly, the water pump 41 is preferably configured as a vane pump type, for example.

A cooling water intake section 71 and a cooling water discharge section 72 are provided on a periphery of the pump housing 45 in which the impeller 68 is housed. The cooling water intake section 71 and the cooling water discharge section 72 are respectively provided with an intake union 71*a* and a discharge union 72*a* The cooling water intake section 71 (the intake union 71*a*) and the cooling water discharge section 72 (the discharge union 72*a*) are both exposed to the outside of the upper casing 2 and directed downward.

As shown in FIG. 1, an intake hole 74 is provided on an outer surface of the lower casing 3 below the waterline WL, and as also shown in FIG. 3, a joint 75 located above the waterline WL is provided near the upper front end of the lower casing 3. The lower casing 3 is provided with an intake passage 76 on its inside. The intake passage 76 preferably includes a metal pipe that extends upward from the intake hole 74 and is connected to the joint 75.

As shown in FIG. 2 to FIG. 4, a cooling water relay section 78 preferably having a trifurcated passage shape is provided on a right outer surface of the upper casing 2 (the upside casing 2*a*). The cooling water relay section 78 includes a relatively thick external conduit member connector 78*a*, which extends in the forward direction of the motor body, and a relatively thin branch conduit member connector 78*b*, which extends upward. In addition, a cooling water supply passage 80 arranged to supply cooling water to the engine 5 side is vertically arranged in the upside casing 2*a* and the mounting plate 4. The cooling water relay section 78 is mounted in accordance with the position of the lower end of the cooling water supply passage 80 and thereby communicates with the cooling water supply passage 80.

An upstream end of an intake-side conduit member 82 is connected to the joint 75 that is the end of the intake passage 76 in the lower casing 3 while a downstream end of the intake-side conduit member 82 is connected to the cooling water intake section 71 (the intake union 71*a*) of the water pump 41. An upstream end of a discharge-side conduit member 83 is connected to the cooling water discharge section 72 (the discharge union 72*a*) of the water pump 41 while a downstream end of the discharge-side conduit member 83 is connected to the external conduit member connector 78*a* of the cooling water relay section 78. The intake-side conduit member 82 and the discharge-side conduit member 83 are both flexible hose members preferably made of resin or rubber.

The conduit members 82, 83 may be the flexible hose members as described above or may be metal pipes with flexibility. In FIG. 2 to FIG. 4, the discharge-side conduit member 83 connects the cooling water discharge section 72 of the water pump 41 to the external conduit member connector 78*a* of the cooling water relay section 78. However, the cooling water discharge section 72 of the water pump 41 may be arranged in the upper casing 2 and directly connected to the cooling water supply passage 80 for supplying cooling water to the engine 5 side.

Meanwhile, as shown in FIGS. 2 and 4, the water jacket 85 is provided in the transmission case 27 of the transmission 26, and a cooling water introducing union 86 in communication with the water jacket 85 is provided on the right side surface of the transmission case 27. A transmission cooling conduit member 87 connects the cooling water introducing union 86 to the branch conduit member connector 78*b* of the cooling water relay section 78.

The transmission cooling conduit member 87 is preferably a flexible hose member, and is arranged such that it enters the upper casing 2 from the outside while moving across an outer edge 2*d* of the pump opening 2*c* defined in a step-like pocket shape.

A bore diameter of the intake-side conduit member 82 is preferably equal or substantially equal to that of the discharge-side conduit member 83. Meanwhile, a bore diameter of the transmission cooling conduit member 87 is preferably smaller than those of the intake-side conduit member 82 and the discharge-side conduit member 83. Such a difference in the bore diameters is determined to be the most appropriate ratio with respect to a ratio of a cooling water amount delivered to a water jacket of the engine 5 to a cooling water amount delivered to the water jacket 85 of the transmission 26.

The intake-side conduit member 82, the discharge-side conduit member 83, and the transmission cooling conduit member 87 along with the water pump 41 and the pump opening 2*c* are covered with the side cover 15. Thus, these members 82, 83, 87, 41, 2*c* are not exposed to the exterior of the outboard motor 1.

When the engine 5 of the outboard motor 1 configured as described above is activated, the rotation of the drive shaft 18 is transmitted to the pump drive shaft 59 at a constant speed by the bevel gear mechanism 55 with its gear ratio set at approximately 1:1. Then, rotation of the pump drive shaft 59 is decelerated to approximately 1/1.5 to approximately 1/2 by the reduction gear mechanism 60 with its gear ratio set at approximately 1:1.5 to approximately 1:2 , and is transmitted to the impeller shaft 63 and the impeller 68. The impeller 68 rotates clockwise as seen in FIG. 7.

When the impeller 68 rotates in the impeller chamber 67 of the pump housing 45, outside water is drawn in from the intake hole 74 due to a negative pressure produced by the cooling water intake section 71. Prior to being supplied as cooling water to a water jacket (not shown) provided in the engine 5 the drawn in water flows through the components in the following order: the intake hole 74 →the intake passage 76 →the joint 75 →the intake-side conduit member 82 →the water pump 41 →the discharge-side conduit member 83 →the cooling water relay section 78 →the cooling water supply passage 80. In addition, some portion of cooling water is branched off at the cooling water relay section 78 and then supplied to the water jacket 85 in the transmission 26 through the transmission cooling conduit member 87.

Cooling water that has cooled the engine 5 and the transmission 26 is discharged to the outside together with exhaust gases through an expansion chamber (not shown) arranged in the casing 12 and also through the exhaust passage 23 in the axes of the first propeller 21*a* and the second propeller 21*b*.

In the outboard motor 1, all the conduit members around the water pump 41 such as, for example, the intake-side conduit member 82, the discharge-side conduit member 83, and the transmission cooling conduit member 87 are disposed outside the casing 12. With such an arrangement, these conduit members 82, 83, 87 can be freely disposed without being affected by the multiple components disposed in the casing 12 such as, for example, the drive shaft 18, the transmission 26, an oil pan, and the expansion chamber. Consequently, it is possible to dramatically improve the layouts of the conduit members 82, 83, 87.

In addition, the bore diameters of the intake-side conduit member 82 and the discharge-side conduit member 83, which are disposed outside the casing 12, can be larger than a bore diameter of a conventional cooling water conduit member built into a casing. This enables an improvement in a discharging performance of the water pump 41 and consequently an improvement in a cooling effect of the engine 5. At the same time, it is possible to eliminate a concern for deterioration of each conduit member 82, 83, 87 due to the influence of exhaust heat and exhaust components.

In addition, when the lower casing 3 is mounted to the upper casing 2, it is no longer necessary to perform difficult assembly work such as, for example, inserting a lower end of a cooling water conduit member, which is built into the upper casing 2 as a conventional conduit member, into a water pump, provided on a top surface of the lower casing 3 or the like. Thus, in addition to the improvement in the assembly workability of the outboard motor 1, it is possible to eliminate water leakage from a joint at the lower end of the cooling water conduit member and its surroundings that cannot be identified visually, which is a problem in conventional apparatuses.

In the outboard motor 1, the water pump 41 is disposed outside the upper casing 2, and both the cooling water intake section 71 and the cooling water discharge section 72 of the water pump 41 are exposed to the outside of the upper casing 2. Thus, it is extremely easy to connect the intake-side conduit member 82 to the cooling water intake section 71 and the discharge-side conduit member 83 to the water discharge section 72. This also contributes to the improvement in the assembly workability of the outboard motor 1.

As described in the present preferred embodiment, when the water pump 41 is arranged so as to be exposed to the outside of the upper casing 2, the impeller 68, which is a component that requires periodical replacement, can be easily replaced simply by removing the pump housing 45 that is exposed to the outside. Accordingly, because there is no need to remove the intake-side conduit member 82 and the discharge-side conduit member 83, both of which are flexible hose members, from the pump housing 45 during the impeller replacement, the maintainability associated with the replacement of the impeller 68 is extremely high.

In the outboard motor 1, the cooling water relay section 78 is preferably provided on the outer surface of the upper casing 2 and is communicated with the cooling water supply passage 80 that supplies cooling water to the engine 5 side. Also, the discharge-side conduit member 83 extending from the water pump 41 is connected to the external conduit member connector 78*a* provided in the cooling water relay section 78. Thus, while discharge-side conduit member 83 can be shortened, a degree of the freedom in the piping layout thereof can be dramatically increased. In addition, it is possible to increase a degree of freedom in shape of the cooling water supply passage 80 as well as the mounting position thereof.

The branch conduit member connector 78*b* is provided in the cooling water relay section 78, and the transmission cooling conduit member 87, which is connected to the water jacket 85 of the transmission 26, is connected to the branch conduit member connector 78*b*. Thus, some of the cooling water supplied from the discharge-side conduit member 83 can be partially distributed to the transmission 26, which is another heat-generating component. Consequently, the transmission 26 can be effectively cooled down by an extremely simple configuration.

As described so far, since cooling water is split between the engine 5 side and the transmission 26 side at the cooling water relay section 78, another cooling system that differs from a cooling system for the engine 5 can be constructed to eliminate influence of each other. Additionally, a configuration in which cooling water is supplied not only to the transmission 26 but also to other heat-generating components such as, for example, electric equipment maybe adopted. Also, a plurality of branch conduit member connectors 78*b* may be arranged to simultaneously distribute cooling water to a plurality of heat-generating components of the engine 5 or to a plurality of heat-generating components other than the engine 5.

Furthermore, in the outboard motor 1, the bore diameters of the intake-side conduit member 82 and the discharge-side conduit member 83 are preferably set to be different from the bore diameter of the transmission cooling conduit member 87 (that is: 82=83>87). Thus, with the different setting of the bore diameter of each conduit member 82, 83, 87, it is possible to easily set a ratio of the cooling water supply for the engine 5 side to that for a component other than the engine (that is the transmission 26 in this preferred embodiment).

Moreover, since the intake-side conduit member 82, the discharge-side conduit member 83, and the transmission cooling conduit member 87 are preferably made of flexible hose members, it is possible to improve the layouts of the piping 82, 83, 87. The assembly workability of the outboard motor 1 can further be improved by facilitating the connections among the piping 82, 83, 87.

Here, in this preferred embodiment, the configuration in which the water pump 41 is completely exposed to the outside of the casing 12 is adopted. However, the water pump 41 itself does not have to be disposed outside the casing 12. For example, the water pump 41 may be provided in the casing 12, and only the cooling water intake section 71 and the cooling water discharge section 72 may be open to the outside of the casing 12. Also, the intake-side conduit member 82 and the discharge-side conduit member 83 may be disposed outside the casing 12.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

an engine mounted above a casing;

a drive shaft arranged to receive a rotational output from a crankshaft of the engine and to transmit the rotational output to a propeller shaft;

a water pump arranged to draw in outside water through an intake hole provided below the casing and to supply the outside water to the engine; and an intake-side conduit member, which is disposed outside the casing, including an upstream end connected to the intake hole and a downstream end connected to a cooling water intake section of the water pump.

2. The outboard motor according to claim 1, further comprising a discharge-side conduit member, disposed outside of the casing, including an upstream end connected to a cooling water discharge section of the water pump and a downstream end connected to a cooling water supply passage that is arranged inside the casing to supply cooling water to a side of the engine.

3. The outboard motor according to claim 2 further comprising a cooling water relay section, provided outside of the casing, arranged to connect the cooling water supply passage to the downstream end of the discharge-side conduit member.

4. The outboard motor according to claim 3, wherein the cooling water relay section has at least one branch conduit member that distributes cooling water supplied from the discharge-side conduit member to a passage that is different from the cooling water supply passage.

5. The outboard motor according to claim 4, wherein bore diameters of the intake-side conduit member and the discharge-side conduit member are different from a bore diameter of the branch conduit member.

6. The outboard motor according to claim 4, wherein the other end of the branch conduit member is connected to a water jacket arranged to cool a transmission.

7. The outboard motor according to claim 1, wherein the water pump is exposed to the outside of the casing.

* * * * *